United States Patent [19]

Tisma

[11] 4,228,622

[45] Oct. 21, 1980

[54] AUTOMOBILE SHELTER APPARATUS

[76] Inventor: Ilija Tisma, 4563 Polk St., Gary, Ind. 46408

[21] Appl. No.: 933,100

[22] Filed: Aug. 11, 1978

[51] Int. Cl.[3] ..... E04H 6/04; E04B 1/343

[52] U.S. Cl. ..... 52/3; 52/63; 52/143

[58] Field of Search ..... 52/3, 63, 64, 79.7, 52/143; 160/22; 135/1 A, 5 A, 5 AT; 150/52

[56] References Cited

U.S. PATENT DOCUMENTS

| | | | |
|---|---|---|---|
| 1,719,055 | 7/1929 | Herzer | 52/3 |
| 2,079,073 | 5/1937 | Knoll | 160/22 |
| 2,097,923 | 11/1937 | Hutchinson | 135/5 A |
| 2,132,238 | 10/1938 | Haisty | 52/3 X |
| 2,740,997 | 4/1956 | Gipslis | 52/143 X |
| 2,806,478 | 9/1957 | Sherbinin | 135/5 A |
| 2,852,814 | 9/1958 | Bignardi | 52/143 |
| 3,103,706 | 9/1963 | Dyck | 52/79.7 |
| 3,186,734 | 6/1965 | Touhey | 52/143 X |
| 3,346,295 | 10/1967 | Byer | 52/143 X |
| 3,600,866 | 8/1971 | Griffith | 52/143 |
| 3,952,758 | 4/1976 | Addison et al. | 135/5 AT |

FOREIGN PATENT DOCUMENTS

| | | | |
|---|---|---|---|
| 864958 | 4/1961 | United Kingdom | 52/63 |

*Primary Examiner*—J. Karl Bell
*Attorney, Agent, or Firm*—Walter Leuca

[57] ABSTRACT

This invention is an automobile shelter apparatus comprising an open ended housing to cover the hood portion of the automobile. A rectangular frame of elongated members is supported on the top side of the housing by guide means through which the frame is longitudinally extended rearwardly of the open end of the housing over the body of the automobile. A roller is mounted on the top of the housing extending transversally thereof on which is stored a tarpaulin cover which is unrolled therefrom to extend rearwardly of the open end of the housing to drape over the extended frame and protectively cover the body of the automobile. A crank handle is provided on the roller to convolutely gather the cover thereon for storage when not in use.

1 Claim, 8 Drawing Figures

AUTOMOBILE SHELTER APPARATUS

BACKGROUND OF THE INVENTION

1. Field of the Invention

This invention relates generally to automobile protectors and more particularly to a novel carport.

2. Description of the Prior Art

This invention is directed to the problem of protecting automobiles from inclement weather by providing an inexpensive, compact but effective protector for automobiles. Prior art carports and garages for storing automobiles are generally large structures permanently fixed to the ground and may not be moved to suit the protective needs of automobile owners which may change from time to time. Such structures are large, permanent and expensive. I am aware of prior art carports and garages in the form of trailers which may be portable, however, such trailer type carports and garages encompass the entire automobile and accordingly are, though portable, large, expensive to manufacture and burdensome to handle.

SUMMARY OF THE INVENTION

Accordingly, this invention is an apparatus for protecting automobiles which is novel in concept obviating disadvantages of the prior art structures in that this invention is portable, compact, inexpensive to manufacture, easy to manipulate and effective in its protective purpose, that is, to protect the automobile from inclement weather. The carport of this invention may be manually maneuvered to where the automobile is parked instead of maneuvering the automobile into the carport structure as it is necessary with prior art apparatus and structures. The apparatus of this invention comprises generally a hood housing rectangular in plan and generally trapezoidal shaped in elevation only sufficiently large to cover the hood portion of the automobile. A manually operable covering apparatus extensible from the top side of the housing is provided to cover the body of the automobile rearward of the hood.

Other objects and advantages of my invention will become more apparent after a careful study of the following detailed description taken together with the accompanying drawings which illustrate preferred embodiments of my invention.

DESCRIPTION OF THE PREFERRED EMBODIMENT

Figure 2:
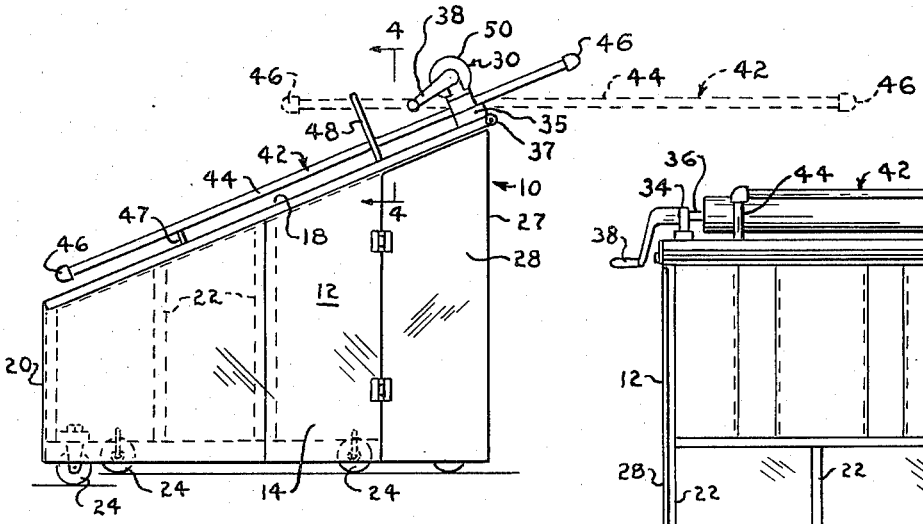
FIG. 2 is a side elevation of the hood housing of this invention showing the tarpaulin frame in retracted position in solid lines and in extended position in dotted lines.
Figure 3:
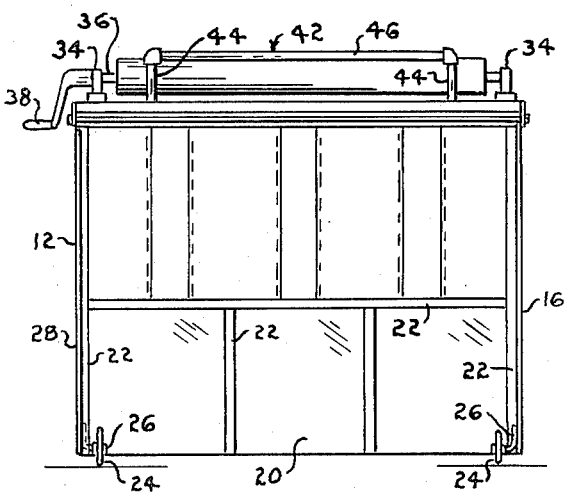
FIG. 3 is an end view taken from the right side of FIG. 2.

With reference now to the drawings, particularly FIGS. 1 to 6 wherein is illustrated a preferred embodiment of my invention, numeral 10 designates generally the automobile shelter apparatus thereof. It comprises an automobile hood housing 12 having trapezoidal shaped side walls 14 and 16. Top wall 18 of housing 12 is generally rectangular in plan and slopes downward to the forward ends of side walls 14 and 16 where they coterminate at front rectangular end 20 to complete the enclosure of the hood housing structure of this invention. Side walls 14 and 16, sloping top wall 18 and front end wall 20 may be supported on or reinforced by suitable frame members 22 interior of the structure. Wheels 24 may be provided at the bottom of the housing whereby the apparatus of this invention may be manually maneuvered as desired. To accomplish this purpose, axle 26 of wheels 24 may be connected to frame members 22 so that wheels 24 may swivel and, in addition, may be pivotally connected to the frame members so that the bottom edge of the housing may be elevated above the ground when it is desired to move the structure and lowered so that the bottom edge thereof may rest on the ground when placed in position. Wheel axle devices to accomplish these objectives are well known and are not shown or described in detail. Side walls 14 and 16 may be provided at the open end of the housing with a hinged panel 28 operable to swing outwardly to enlarge the open end 27 of housing 12 in order that the front doors of the automobile pocketed in the structure may be opened so that access may be had to the interior of the automobile without interference by the structure of the housing. Housing 12 is preferably provided with insulation (not shown) to assist in preventing rapid heat loss from the automobile engine during cold weather.

On sloped top wall 18, I provide mechanism 30 for an extendable cover 32. It is understood that cover 32 can be any of any suitable material and for purposes of this specification further reference to tarpaulin is to be understood to include plastic, canvas or any such material which is flexible and water resistant.

Figure 1:
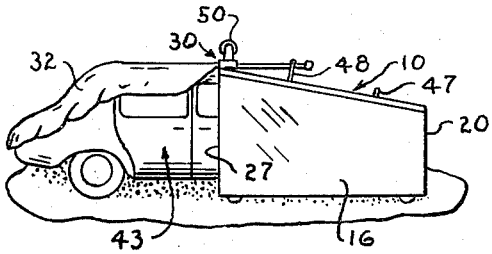
FIG. 1 is a side view of the automobile shelter apparatus of this invention shown in operative relation with an automobile.
Figure 4:
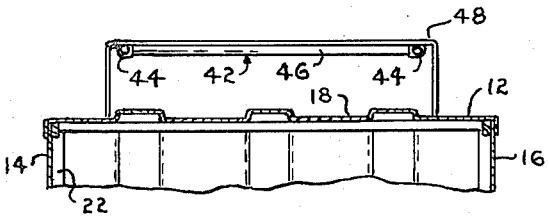
FIG. 4 is a fragmentary cross sectional view taken along the plane of lines 4—4.
Figure 5:
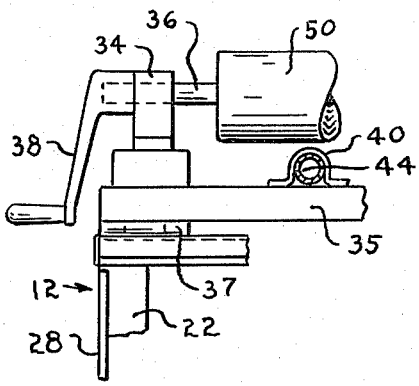
FIG. 5 is a detail front view of the tarpaulin drape mechanism of this invention shown in fragment.
Figure 6:
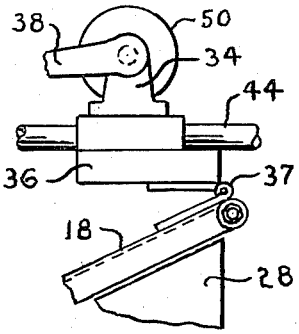
FIG. 6 is a detail side view of the tarpaulin drape mechanism showing the hinge action of the base plate.

Mechanism 30 comprises spaced bearings 34 mounted on a transverse plate 35 which is hinged as at 37 to the top edge of housing 12. Bearings 34 rotatably support shaft 36 extending thereacross. One end of shaft 36 extends beyond one of bearings 34 to which is keyed hand crank 38 for manually rotating shaft 36. Fixed to plate 35 are laterally spaced brackets 40 which serve to support and guide the longitudinal travel of rectangular frame 42. Frame 42 is extendable rearward of housing 12 over the body of automobile 43 positioned thereunder and serves to support tarpaulin cover 32 draped thereover. I form rectangular frame 42 by connecting the ends of longitudinal and lateral elongated members 44 and 46, respectively. Longitudinal elongated members 44 are supported in spaced brackets 40 through which frame 42 is longitudinally extended and supported. As shown in FIG. 2, when frame 42 is manually extended a sufficient length to provide a lever, frame 42 is pivoted about the fulcrum of hinge 37 to a horizontal position including plate 35 on which it is mounted, and then horizontally extended the balance of its length to cover the body of the automobile. To assist in balancing frame 42 when resting on the sloped top wall 18 of housing 12, cross bar means 47 is provided to support frame 42 in a position parallel to top wall 18 when not in use. When frame 42 is in its longitudinally extended position as shown in FIG. 1 and as shown in FIG. 2 by dotted lines, I provide a second cross bar means 48 fixed to top wall 18 adjacent hinged plate 35 against which frame 42 upwardly bears to limit the pivot movement of frame 42 to the horizontal position when in its longitudinally extended position. Roll 50 on shaft 36 supports tarpaulin cover 32 which may be rolled and unrolled therefrom and pulled over the body of automobile 43 and draped over frame 42 extending over the automobile.

Figure 7:
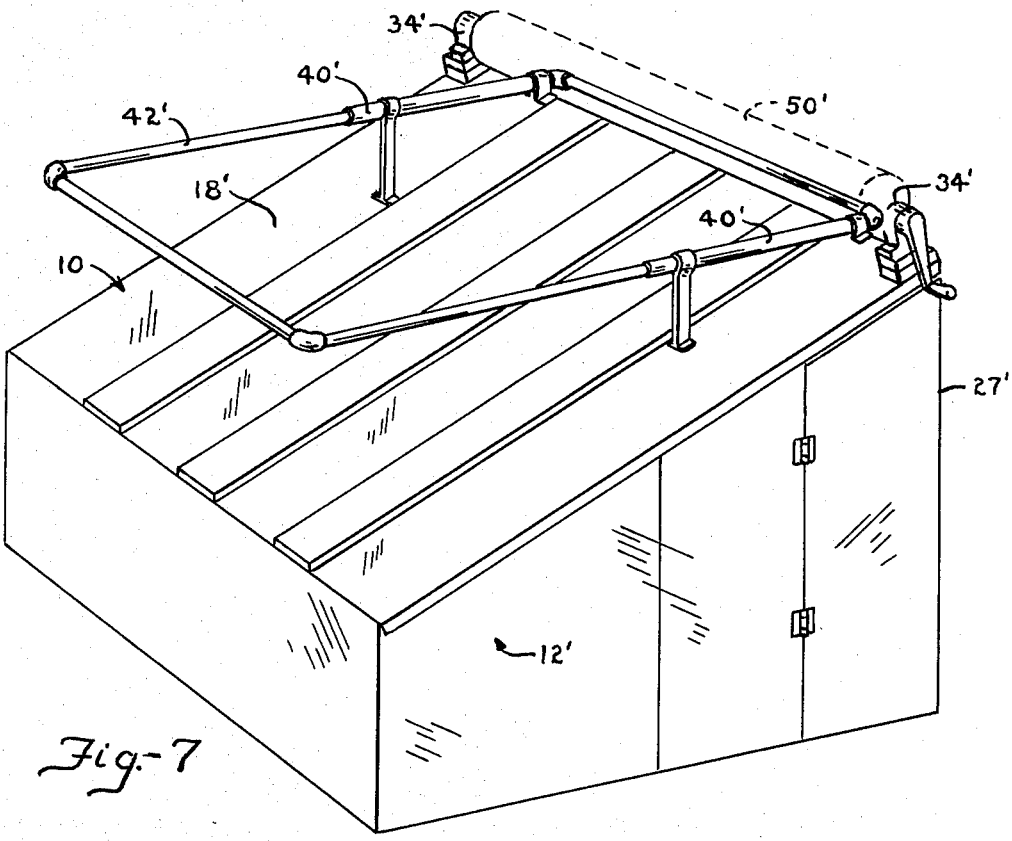
FIG. 7 is a pictorial view of this invention showing another means for supporting the tarpaulin frame in a horizontal position.
Figure 8:
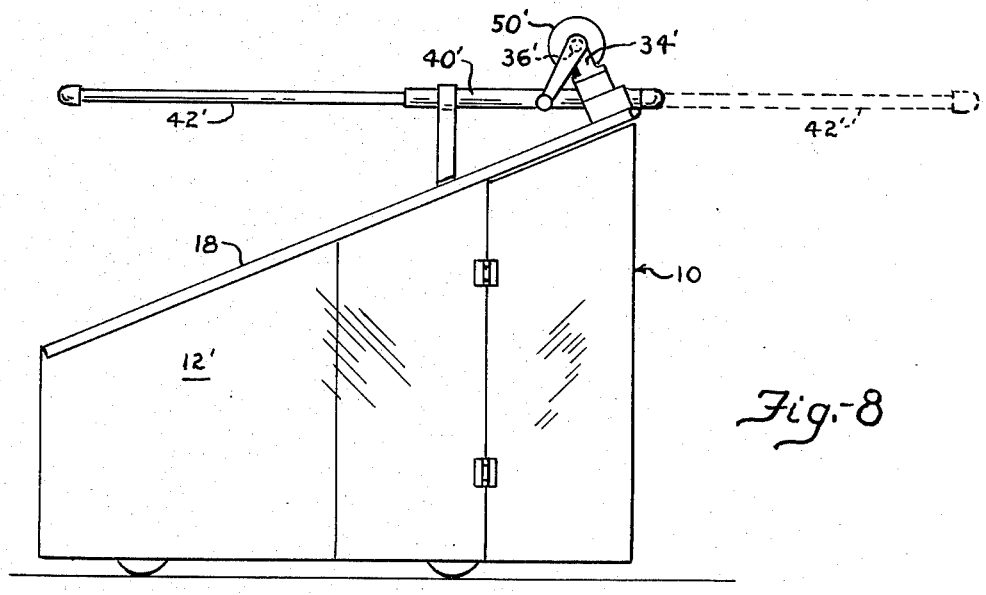
FIG. 8 is a side elevation of the means of FIG. 7.

Another embodiment of my invention illustrated in FIGS. 7 and 8 includes spaced bearings 34' mounted on top wall 18' of housing 12' adjacent the open end 27' thereof for rotatably supporting shaft 36'. Supported on top wall 18' are spaced sleeve members 40' which serve to support and guide the longitudinal travel of rectangular frame 42'. Spaced sleeve members 40' are fixed on top wall 18' in a parallel horizontal position so that frame 42' may be slidable and supported therein in a fixed horizontal position.

In the operation of this invention, the apparatus of this invention may be maneuvered to be positioned in any direction or place by lowering wheels 24 for manual maneuverability. When in position, either by rolling housing 12 over the hood of the parked automobile or driving the automobile into the housing, frame 42 is manually pulled over the top of the body of the automobile to form a supporting frame for tarpaulin cover 32 which is manually unrolled from roll 50 on which it is convolutely stored, and draped over frame 42.

When it is desired to remove the automobile from the apparatus 10 of this invention, I convolutely roll cover 32 by turning crank 38 and longitudinally retract frame 42 to its position over top wall 18 of housing 12. If the automobile is a compact automobile and extends into hood housing 12 so as to interfere with the opening of the door, hinged side panel 28 may be opened to open the door of the automobile.

It is obvious from the above description and illustrated by the drawings that I have provided a simple and economical to manufacture apparatus which effectively protects an automobile from inclement weather and it may be easily maneuvered to any position by manual effort.

I claim:

1. An automobile shelter apparatus comprising:

spaced upright side walls, a top wall connecting said side walls and an upright end wall connecting said side walls and top wall to form an open ended housing;

said housing at said open end thereof having a vertical elevation to cover the windshield component of the automobile;

said upright end of said housing having a vertical elevation to cover the hood component of the automobile;

at least one of said upright sides having a hinged panel for pivoting exterior of said housing to longitudinally extend the open end thereof;

a shaft member horizontally supported across said top wall;

a sheet member convolutely rolled on said shaft member;

spaced longitudinal and lateral elongated members fixed to each other to form a rectangular frame supported on said top wall of said housing;

spaced means on said top wall of said housing to guide said spaced longitudinal elongated members when extended over said automobile;

means on said top wall for restricting pivotal movement of said frame when said frame is extended over said automobile;

said shaft member being rotatable to lay out said sheet member over said frame when said frame is extended over said automobile; and means for rotating said shaft to convolutely roll said sheet member on said shaft.

* * * * *